US010995516B2

(12) United States Patent
Ribner

(10) Patent No.: US 10,995,516 B2
(45) Date of Patent: May 4, 2021

(54) ARTICULATING FRAME SHELTER

(71) Applicant: HDT Expeditionary Systems, Inc., Solon, OH (US)

(72) Inventor: Thad B. Ribner, Fredericksburg, VA (US)

(73) Assignee: HDT Expeditionary Systems, Inc., Solon, OH (US)

( * ) Notice: Subject to any disclaimer, the term of this patent is extended or adjusted under 35 U.S.C. 154(b) by 0 days.

(21) Appl. No.: 16/717,147

(22) Filed: Dec. 17, 2019

(65) Prior Publication Data

US 2020/0190844 A1 Jun. 18, 2020

Related U.S. Application Data

(60) Provisional application No. 62/781,567, filed on Dec. 18, 2018.

(51) Int. Cl.
*E04H 15/50* (2006.01)
*E04H 15/38* (2006.01)

(52) U.S. Cl.
CPC ..... *E04H 15/50* (2013.01); *E04H 15/38* (2013.01)

(58) Field of Classification Search
CPC ..... E04H 15/50
See application file for complete search history.

(56) References Cited

U.S. PATENT DOCUMENTS 4,689,932 A * 9/1987 Zeigler ..... E04B 1/3211 52/653.1
RE33,710 E 10/1991 Zeigler
5,230,196 A 7/1993 Zeigler
5,274,980 A 1/1994 Zeigler
(Continued)

FOREIGN PATENT DOCUMENTS

WO WO 2005/118986 A2 12/2005
WO WO 2012/161983 A1 11/2012

*Primary Examiner* — Noah Chandler Hawk
(74) *Attorney, Agent, or Firm* — Fay Sharpe LLP

(57) ABSTRACT

An articulating frame for a shelter includes a plurality of struts pivotally connected to each other to define a skeletal structure that is adapted to be articulated between a folded condition and an erected condition. The skeletal structure in the erected condition includes a segmented arch that defines an interior space. The skeletal structure is adapted to support an associated outer shell covering. The frame includes at least one double-scissor linkage segment including four of the plurality of struts. The four struts include: (i) first and second struts each with opposite inner and outer ends, the first and second struts bring pivotally connected to each other at a first pivot point located between their respective inner and outer ends; and, (ii) third and fourth struts each with opposite inner and outer ends, the third and fourth struts being pivotally connected to each other at a second pivot point located between their respective inner and outer ends. The inner end of the first strut is pivotally connected to the inner end of the third strut at a third pivot point and the inner end of the second strut is pivotally connected to the inner end of the fourth strut at a fourth pivot point such that a four-bar parallelogram accommodating linkage is defined by the four struts between the first pivot point, the second pivot point, the third pivot point, and the fourth pivot point.

12 Claims, 13 Drawing Sheets

(56) References Cited

U.S. PATENT DOCUMENTS

| | | | | |
|---|---|---|---|---|
| 5,444,946 | A | 8/1995 | Zeigler | |
| 5,651,228 | A | 7/1997 | Zeigler | |
| 6,141,934 | A | 11/2000 | Zeigler | |
| 7,357,238 | B2 | 4/2008 | Zeigler | |
| 7,455,164 | B2 | 11/2008 | Zeigler | |
| 7,481,235 | B2 | 1/2009 | Prusmack | |
| 7,533,498 | B2 | 5/2009 | Zeigler | |
| 7,556,054 | B2 | 7/2009 | Zeigler | |
| 7,712,261 | B2 | 5/2010 | Zeigler | |
| 7,832,170 | B2 | 11/2010 | Zeigler | |
| 8,082,938 | B2 * | 12/2011 | Prusmack | E04B 1/3441 135/135 |
| 9,631,393 | B2 | 4/2017 | Zeigler | |
| 2005/0194032 | A1 | 9/2005 | Zeigler | |
| 2005/0204680 | A1 | 9/2005 | Zeigler | |
| 2005/0204681 | A1 | 9/2005 | Zeigler | |
| 2005/0262779 | A1 | 12/2005 | Zeigler | |
| 2006/0101631 | A1 | 5/2006 | Zeigler | |
| 2006/0157100 | A1 | 7/2006 | Zeigler | |
| 2008/0016817 | A1 | 1/2008 | Zeigler | |
| 2008/0017232 | A1 | 1/2008 | Zeigler | |
| 2008/0017233 | A1 | 1/2008 | Zeigler | |
| 2008/0017234 | A1 | 1/2008 | Zeigler | |
| 2012/0298162 | A1 | 11/2012 | Zeigler | |
| 2017/0175414 | A1 | 6/2017 | Zeigler | |
| 2017/0247906 | A1 | 8/2017 | Zeigler | |

* cited by examiner

ARTICULATING FRAME SHELTER

CROSS-REFERENCE TO RELATED APPLICATION

This application claims priority from and benefit of the filing date of U.S. provisional application Ser. No. 62/781,567 filed Dec. 18, 2018, and the entire disclosure of said provisional application is hereby expressly incorporated by reference into the present specification.

BACKGROUND

Portable, self-supporting, articulating frame shelters are well-known and in widespread use by the military and others. Such articulating frame shelters are collapsible into a relatively compact package that can be stored and transported to a deployment location where the shelter can be quickly deployed or erected and used. The shelter is erected in the field without tools, cranes, power, or other equipment. When fully deployed, the erected shelter comprises a segmented, arched frame including opposite side walls connected by a self-supporting roof span. Examples of such shelters are shown in: U.S. Pat. Nos. 7,481,235; 9,631,393; and, U.S. Patent App. Pub. No. 2017/0247906. As shown in U.S. Pat. No. 9,631,393, the entire disclosure of which is hereby expressly incorporated by reference into the present specification, these shelters are often interconnected in groups making it necessary to have doorways, windows, and other access openings that allow people, equipment, light, and air to travel and flow between the various shelter structures.

These shelter structures comprise a plurality of long, struts that are pivotally interconnected to form an articulating skeletal frame structure. Multiple scissor linkage segments are defined by pairs of struts are pivotally connected at their mid-points by a pin or otherwise to form a generally X-shaped scissor linkage comprising a central pivot point or hinge and four arms that radiate outwardly from the central pivot point/hinge. The frame is constructed by pivotally interconnecting multiple scissor linkage segments (at least two scissor linkage segments) using a hub. The hub, itself, comprises first (upper) and second (lower) hub portions that are releasably interconnected together by a hub post that extends between the first and second hub portions when the frame is erected. The first and second hub portions are selectively separable from each other (with the hub post remaining connected to one of the hub portions) when the frame is collapsed and folded upon itself.

In order for a frame constructed from multiple, interconnected scissor linkages to articulate properly between its collapsed (packed) and expanded (deployed) condition and form an easily packable and transportable cube structure when collapsed, the scissor linkages must all be the same size, i.e., for any two pair of arms of the frame, the sum of the distances (lengths) from the outer pivot point at the distal end of each arm to the central pivot point for the first pair of arms must equal the sum of the distances (lengths) from the outer pivot point at the distal end of each arm to the central pivot point for the second pair of arms. This dimensional scissor-linkage requirement leads to a design trade-off in that longer scissor linkages are often desired for a first part of the shelter frame (e.g., vertical wall regions of the frame that provide doorways or the like for ingress and egress of people and equipment), while for other parts of the frame it is often preferable to use shorter scissor linkages to reduce the overall roof height or to reduce the horizontal span of the structure. Known articulating frame shelter structures do not allow for mixed-length scissor linkage segments since use of scissor linkage segments of different lengths would prevent the frame from properly articulating as required for collapsing and erecting the frame.

As noted above, the hubs used to join adjacent scissor linkage segments include upper and lower hub portions that must be interconnected through a hub post when the frame is erected. Given that there are multiple hubs that extend along the length and width of the frame, it can sometimes be difficult to align and connect all of the upper and lower hub structures when the frame is being deployed. In particular, the hubs that are located adjacent the ground or other support surface on which the shelter is being erected and that are spaced along the length of the shelter frame on the opposite lateral edges can be particularly problematic to assemble when the shelter is erected. Assembling these hubs quickly and effectively is important in order to erect the shelter quickly as required for military and other applications. As such, a need has been identified for a shelter frame that includes a system for facilitating the assembly of the hubs at least along the opposite lateral edges of the shelter frame.

Another difficulty with erecting known shelter frames relates to the installation of the liner. Known shelter frames include an outer fabric or other flexible membrane that covers the outer surface of the articulating frame and that provides shelter from the external environment such as the weather and other surrounding conditions. It is desirable to further include a liner that covers the internal side of the articulating framework to provide a double-walled structure that has improved thermal insulation, sound insulation, opacity to light, and otherwise generally improves the internal appearance and conditions of the shelter. These liners are typically installed in a manner that results in a sagging appearance due to the excess material or "slack" required to accommodate movement of the articulating frame during the process of erecting the frame. In particular, the liner is typically connected to the frame when the frame is in a partially erected state, and excess liner material is required so that the liner does not become tensioned and resist movement of the frame toward its fully erected state. Any excess material or sagging of the liner is highly undesirable and reduces the effective interior space of the shelter.

As noted, known articulating frames for shelters include a plurality of hubs that each comprise an upper hub portion and a lower hub portion releasably connected together by a hub post. These upper and lower hub portions are disconnected from each other when the shelter is collapsed and folded. When the frame is erected, these hubs are required to resist heavy loads from wind, snow, and the like, but must also be capable of being assembled without tools in the field. Known hub structures have been found to be generally effective, but a need has been identified for a new and improved hub for an articulating frame shelter that is easy to assemble and that provides even better strength, rigidity, and resistance to separation of the upper and lower hub components.

Another drawback with known articulating frame shelters is that any door structure defined in the shelters includes a scissor linkage that extends across the threshold of the door opening. The threshold scissor linkage is necessary in order for the articulating frame to maintain its alignment when it is being erected or collapsed. Once the shelter frame is fully erected, the presence of the threshold scissor linkage is undesirable for several reasons. This threshold scissor linkage can present a tripping hazard to those walking into and out of the shelter. Furthermore, a cart or vehicle entering the shelter must roll over the threshold scissor linkage and can damage same. As such, a need has been identified for an articulating frame shelter that overcomes these issues.

SUMMARY

According to a first embodiment of the present development, an articulating frame for a shelter includes a plurality of struts pivotally connected to each other to define a skeletal structure that is adapted to be articulated between a folded condition and an erected condition. The skeletal structure in said erected condition comprises a segmented arch that defines an interior space. The segmented arch skeletal structure is adapted to support an associated outer shell covering. The frame includes at least one double-scissor linkage segment comprising four of the plurality of struts. The four struts include: (i) first and second struts each comprising opposite inner and outer ends, the first and second struts being pivotally connected to each other at a first pivot point located between their respective inner and outer ends; and, (ii) third and fourth struts each comprising opposite inner and outer ends, the third and fourth struts being pivotally connected to each other at a second pivot point located between their respective inner and outer ends. The inner end of the first strut is pivotally connected to the inner end of the third strut at a third pivot point and the inner end of the second strut is pivotally connected to the inner end of the fourth strut at a fourth pivot point such that a four-bar parallelogram accommodating linkage is defined by the four struts between the first pivot point, the second pivot point, the third pivot point, and the fourth pivot point.

In another embodiment, a double-scissor linkage for a articulating shelter frame comprises four struts including: (i) first and second struts each comprising opposite inner and outer ends, the first and second struts bring pivotally connected to each other at a first pivot point located between their respective inner and outer ends; and, (ii) third and fourth struts each comprising opposite inner and outer ends, the third and fourth struts being pivotally connected to each other at a second pivot point located between their respective inner and outer ends. The inner end of the first strut is pivotally connected to the inner end of the third strut at a third pivot point and the inner end of the second strut is pivotally connected to the inner end of the fourth strut at a fourth pivot point such that a four-bar parallelogram accommodating linkage is defined by the four struts between the first pivot point, the second pivot point, the third pivot point, and the fourth pivot point.

DETAILED DESCRIPTION OF THE INVENTION

Figure 1:
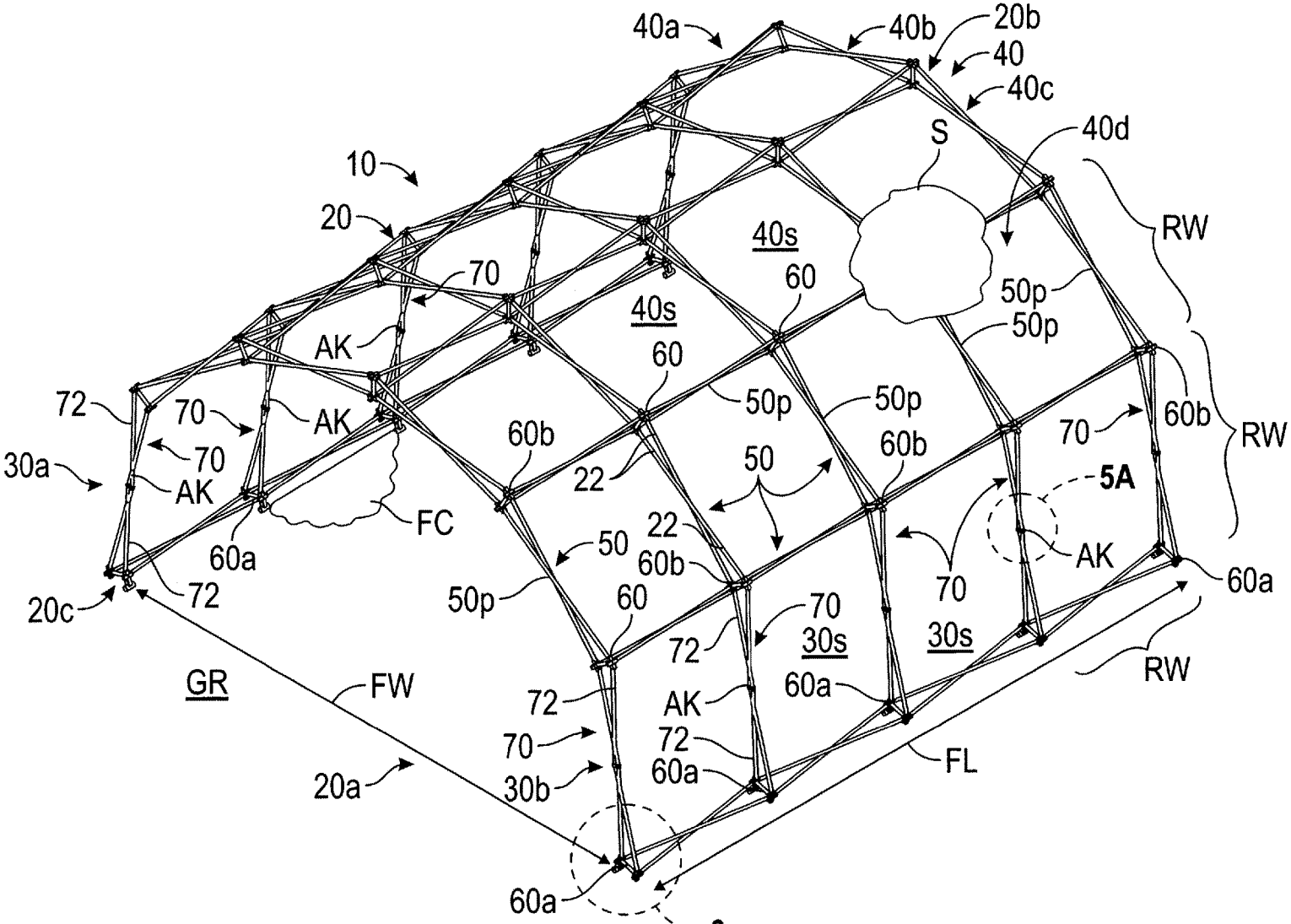
FIG. 1 is an isometric view of an articulating frame shelter constructed in accordance with an embodiment of the present development (partially showing the flexible outer shell covering), with the frame fully erected/deployed.

As shown in FIGS. 1-6, a shelter 10 provided in accordance with an embodiment of the present development comprises an articulating frame 20 and an outer covering or outer shell S connected to an outer side of the frame 20. When erected as shown in FIG. 1, an inner skeletal surface of the frame 20 defines a hollow interior space IS for sheltering people, equipment, animals, and other resources from weather and other external environmental conditions. With brief reference to FIG. 7, the shelter 10 optionally comprises an inner liner LN comprising a flexible fabric or similar covering that is connected to the inner side of the frame 20 such that the inner liner LN and outer shell S define a double-walled covering for the shelter 10, with the frame 20 located in the space between the outer shell S and the inner liner LN.

Figure 2:
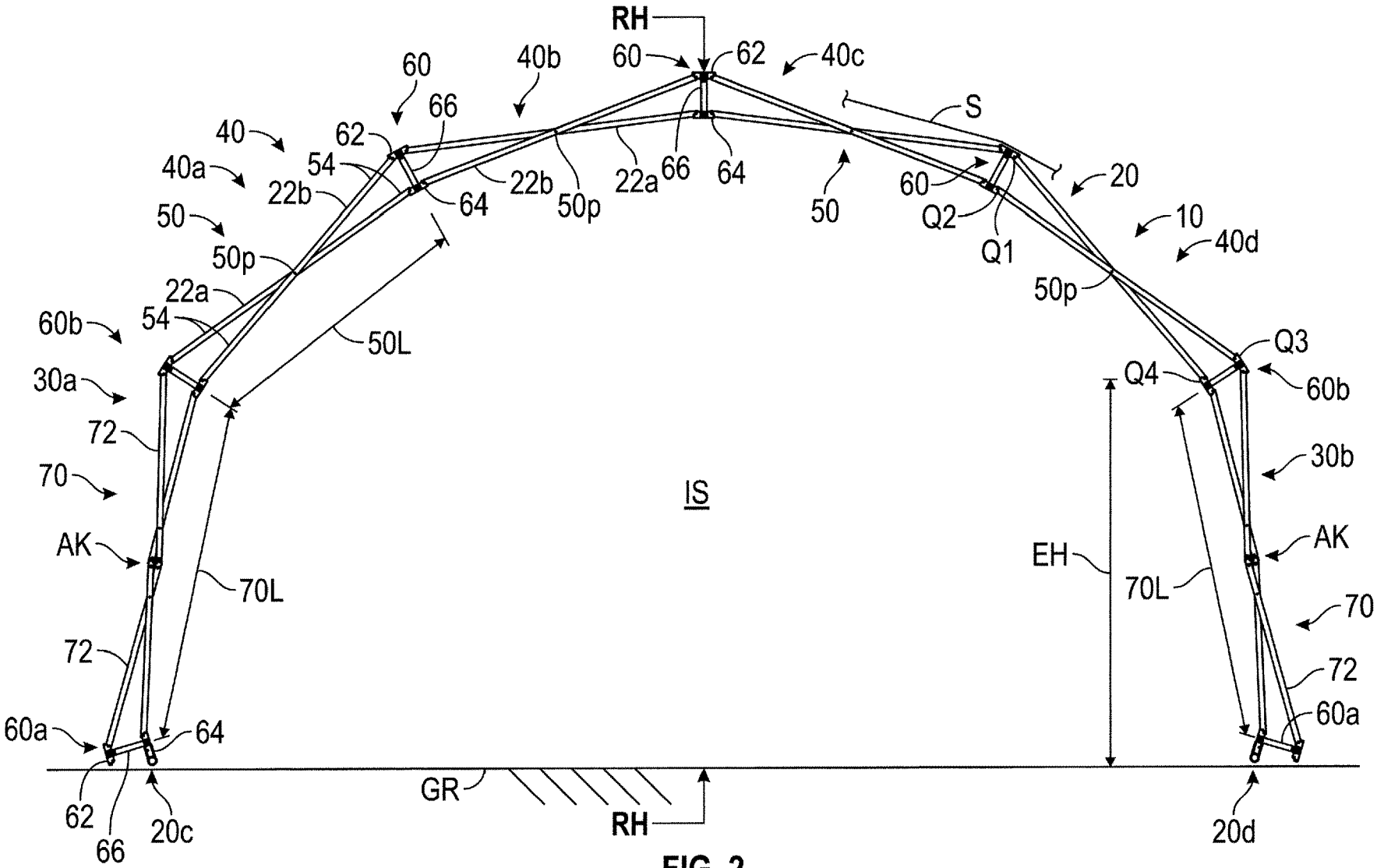
FIG. 2 is a first end view of the shelter of FIG. 1 (the opposite end view is substantially identical)
Figure 3:
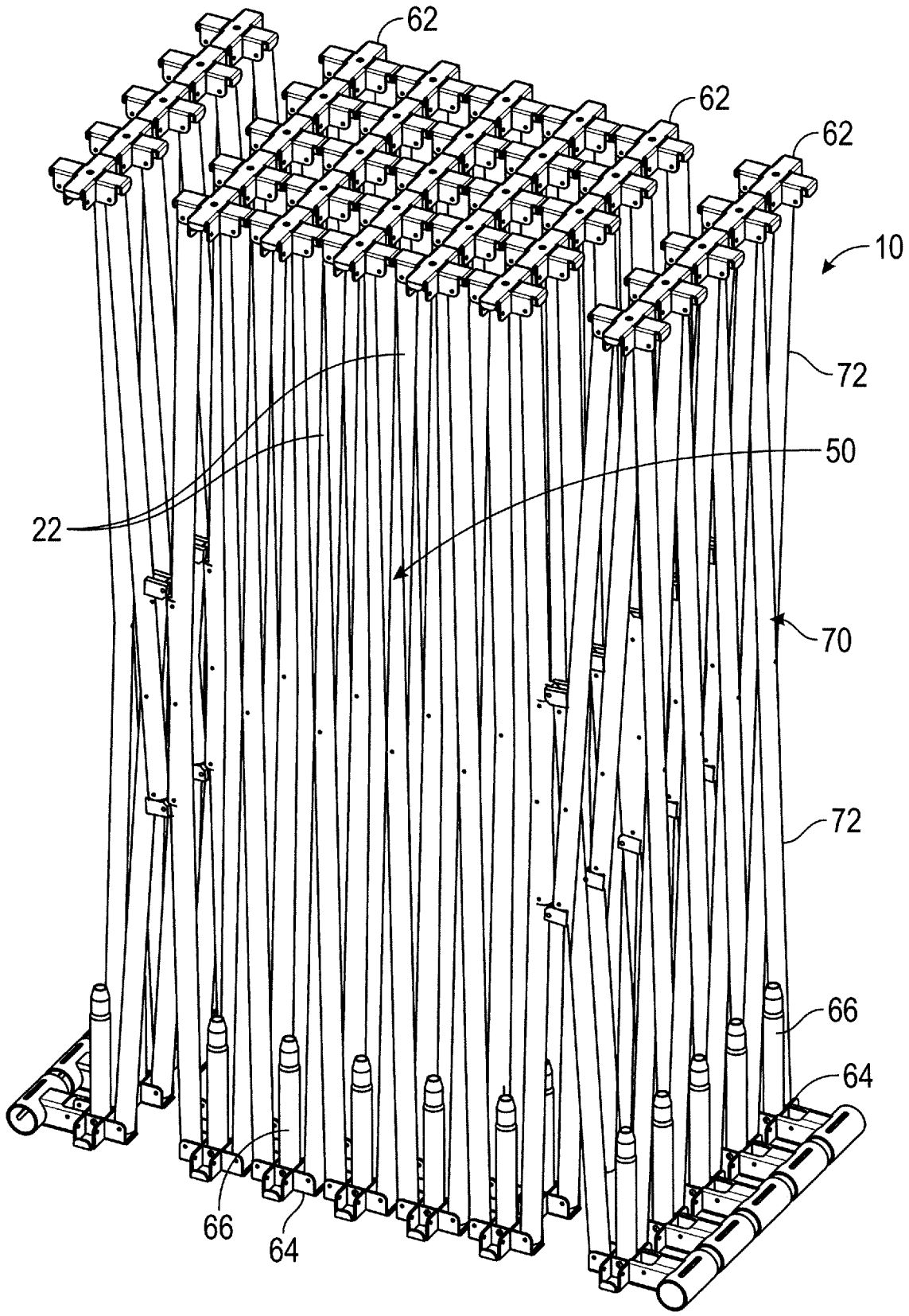
FIG. 3 shows the frame of FIGS. 1 & 2 in a fully collapsed, folded, or packed state in which it forms a cubic structure for storage and transport (the flexible outer shell covering is not shown in FIG. 3)
Figure 4:
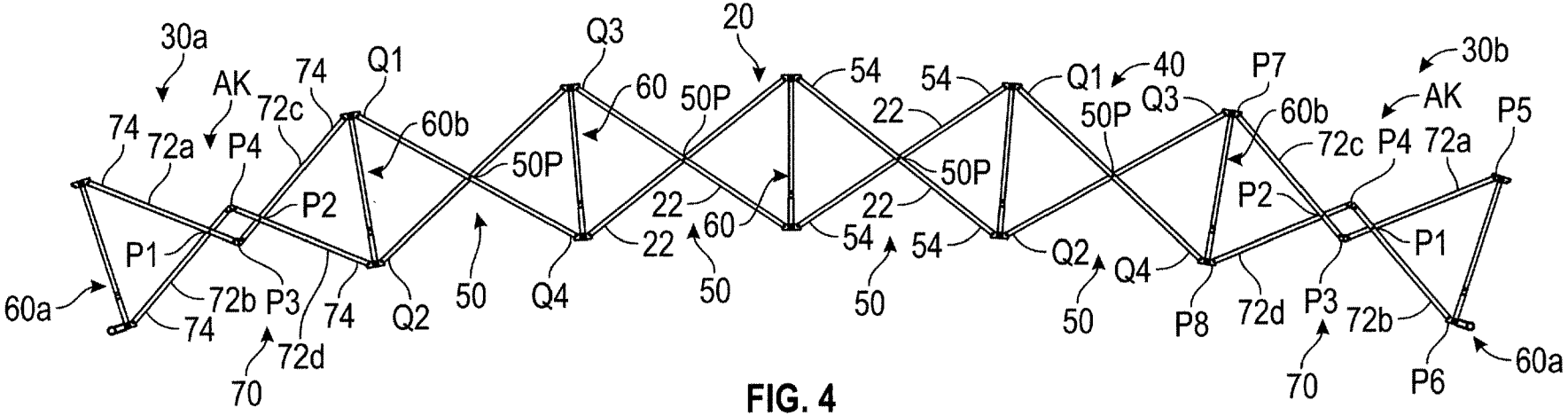
FIG. 4 shows the frame of FIGS. 1 & 2 in a partially collapsed or partially deployed state between its fully collapsed and fully deployed configurations (the flexible outer shell covering is not shown in FIG. 4)

With continuing reference to FIGS. 1-6, the frame 20 comprises a plurality of struts 22,72 that are pivotally connected to each other such that the frame 20 can articulate from a folded position or condition shown in FIG. 3 to the fully erected position or condition shown in FIGS. 1 & 2, through an intermediate (partially erected/partially folded) position or condition shown in FIG. 4. The fully erected frame 20 defines a skeletal structure that supports the outer shell S and the optional inner liner LN. The frame struts 22,72 are typically defined from a strong, lightweight metal such as aluminum and are generally tubular in structure, but the struts can be solid and/or can be defined from any other suitable metallic and/or non-metallic strut material such as fiberglass, carbon fiber, wood, and/or polymeric materials. The pivoting connections are provided by rivets, pins, bolts, or other suitable fasteners or pivoting connections.

As shown in FIGS. 1 & 2, the erected frame 20 defines a length FL between its opposite front and rear ends 20*a*,20*b*, and defines a width FW between its opposite left and right lateral sides 20*c*,20*d*. The width FW is measured where the opposite lateral sides 20*c*,20*d* of the frame 20 contact the floor, ground, or other support surface GR on which the frame 20 is supported.

The frame 20 comprises left and right side walls 30*a*,30*b* each comprising and defined by a plurality of rectangular wall sections 30*s*. In the illustrated example, the left and right side walls 30*a*,30*b* are identical to each other but arranged in a mirror image fashion relative to each other. The frame 20 further comprises a roof 40 comprising and defined by multiple roof spans 40*a*, 40*b*, 40*c* that each extend along the length FL of the frame and that each comprise a plurality of rectangular roof sections 40*s*.

The wall sections 30*s* and roof sections 40*s* each comprises a plurality of primary scissor linkage segments 50. Each primary scissor linkage segment 50 comprises a pair of identical first and second struts 22*a*,22*b* (generally 22) pivotally connected to each other between their opposite outer ends 54 at their respective mid-points by a pin or the like to form a generally X-shaped scissor linkage comprising a central or inner pivot point 50P. Each individual primary scissor linkage segment 50 defines a first length 50L when the shelter frame 20 is fully erected. The first length 50L can be measured in a straight line between the respective outer ends 54 of the first and second struts 22 between successive hubs 60.

The primary scissor linkage segments 50 are pivotally interconnected to each other by a plurality of hubs 60. Each hub 60 comprises an upper hub portion 62, and lower hub portion 64 spaced-apart from the upper hub portion 62, and a post 66 that extends between and interconnects the upper and lower hub portions 62,64. The post 66 is fixedly secured at one end to the lower hub 64 (or upper hub 62) and is selectively, releasably secured to the opposite upper hub 62 (or lower hub 64) when the frame 20 is erected. The upper and lower hub portions 62,64 are each respectively pivotally connected two or more struts 22, at the outer ends of each primary scissor linkage segment 50 spaced from the internal scissor pivot point 50P as indicated at first, second, third, and fourth pivot points respectively labeled Q1,Q2,Q3,Q4.

In the illustrated embodiment, roof 40 of the frame 20 comprises a plurality of the primary scissor linkage segments 50 arranged in a rectangular grid or matrix to define the plurality of rectangular roof sections 50*s*, wherein each span 40*a*,40*b*,40*c* of the roof 40 comprises a column of adjacent roof sections 40*s*.

According to the present invention, the walls 30 of the frame 20 are constructed to have a height or "eave height" EH (FIG. 2) that is greater than the length 50L of each primary scissor linkage segment 50, while still permitting the frame 20 to articulate as needed between its folded position (FIG. 3) and its erected position (FIGS. 1 & 2). This is accomplished by defining each wall section 30*s* to include first and second double-scissor linkage segments 70 that are vertically oriented and located on the opposite lateral sides of each wall section 30*s* and that are connected by upper and lower horizontally extending primary scissor linkage segments 50 (or that are connected by upper and lower horizontally extending double-scissor linkage segments 70). As such, for each wall section 30*s*, a first one 70*a* of the double-scissor linkage segments 70 is located closer to the front end 20*a* of the frame 20 and a second one 70*b* of the double-scissor linkage segments 70 is located closer to the rear end 20*b* of the frame 20. The double-scissor linkage segments 70 define a second length 70L when the frame 20 is erected which equals the eave height EH, and this second length 70L is greater than the first length 50L of the primary scissor linkage segments 50 (70L>50L) so that eave height EH is always at least equal to the second length 70L and is always greater than the first length 50L of the primary scissor linkage segments 50. The second length 70L can be measured in a straight line between successive hubs 60 and between the outer end 74 of the second strut 72*b* and the outer end 74 of the fourth strut 72*d*.

Despite its longer length 70L, a double-scissor linkage segment 70 is able to articulate as needed with the primary scissor linkage segments 50 of frame 20 because each double-scissor linkage segment 70 comprises a central accommodating linkage AK that provides additional length to each double-scissor linkage segment 70 when the frame 20 is erected and but that folds or articulates to accommodate or absorbs the additional length when the frame is folded.

Figure 4A:
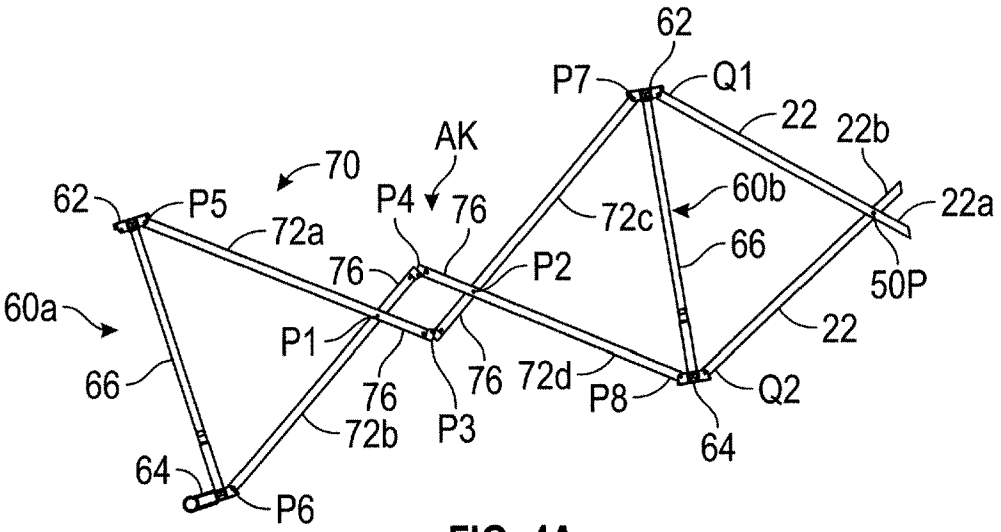
FIG. 4A illustrates an enlarged portion of FIG. 4 and shows a double-scissor linkage constructed according to an embodiment of the present invention.

As shown in the enlarged view of the partially erected frame in FIG. 4A, the double-scissor linkage segments 70 each comprise four elongated struts 72 (i.e., 72*a*,72*b*,72*c*, 72*d*) that are identical to the struts 22 of the primary scissor linkage segments 50 except that the elongated struts 72 are longer then the struts 22 of the primary scissor linkage segments 50. The struts 72 (72*a*,72*b*,72*c*,72*d*) can be as little as 1 inch or less longer than the struts 22 or as much as twice the length or more than the struts 22 without departing from the scope and intent of the present development, with these variations limited by the space required to accommodate the joints (for very small added lengths) and by the required structural stability (for very large added lengths). First and second ones of the elongated struts 72*a*,72*b* are respectively connected at their outer ends 74 to the upper and lower hub portions 62,64 of an outer hub 60*a* and are pivotally connected to each other at a first pivot point P1 where they intersect between their opposite outer and inner ends 74,76. The first pivot point P1 need not be centrally located on the struts 72*a*,72*b* and is located closer to the strut inner ends 76 in the illustrated example. Furthermore, the distance between the outer end 74 and the first pivot point P1 need not be the same for both the first and second struts 72*a*,72*b*; and (ii) the distance between the inner end 76 and the first pivot point P1 need not be the same for both the first and second struts 72*a*,72*b*.

Similarly, the third and fourth struts 72*c*,72*d* are respectively connected at their outer ends 74 to the upper and lower hub portions 62,64 of an inner hub 60*b* and are pivotally connected to each other at a second pivot point P2 where they intersect between their opposite outer and inner ends 74,76. The distance between the outer end 74 and the second pivot point P2 need not be the same for both the third and fourth struts 72*c*,72*d*; and (ii) the distance between the inner end 76 and the second pivot point P2 need not be the same for both the third and fourth struts 72*c*,72*d*.

Figure 5A:
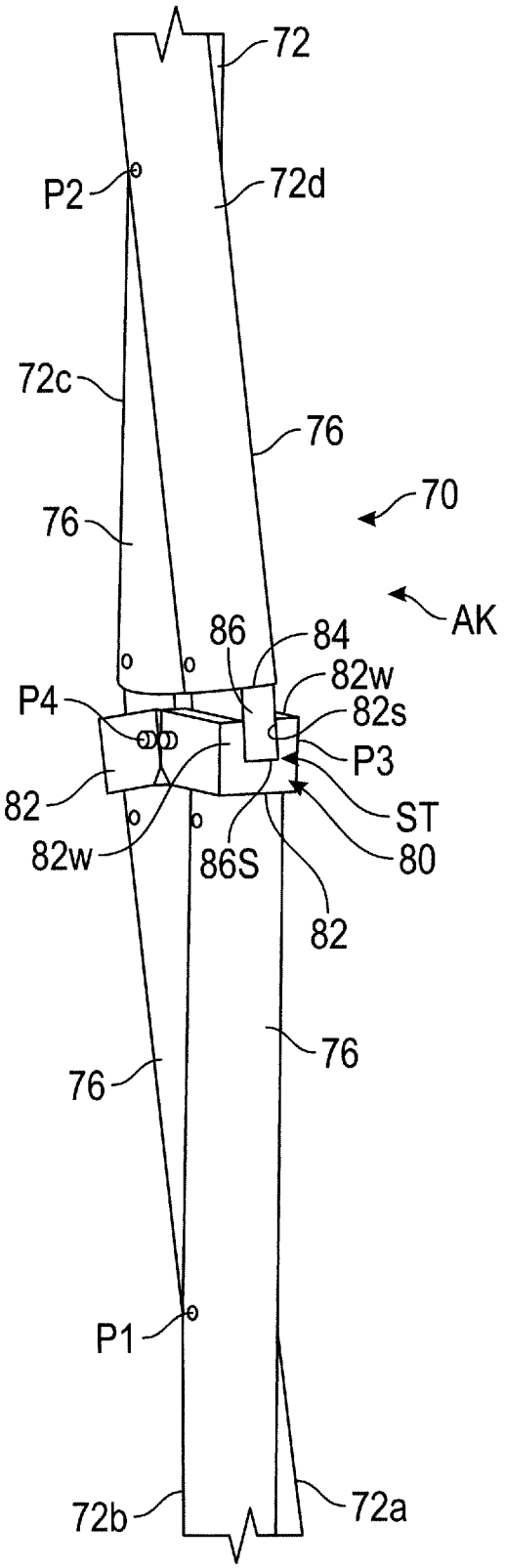
FIG. 5A partially illustrates another view of the double-scissor linkage of FIG. 4A and shows a hard stop knee hinge portion of the double-scissor linkage.
Figure 5B:
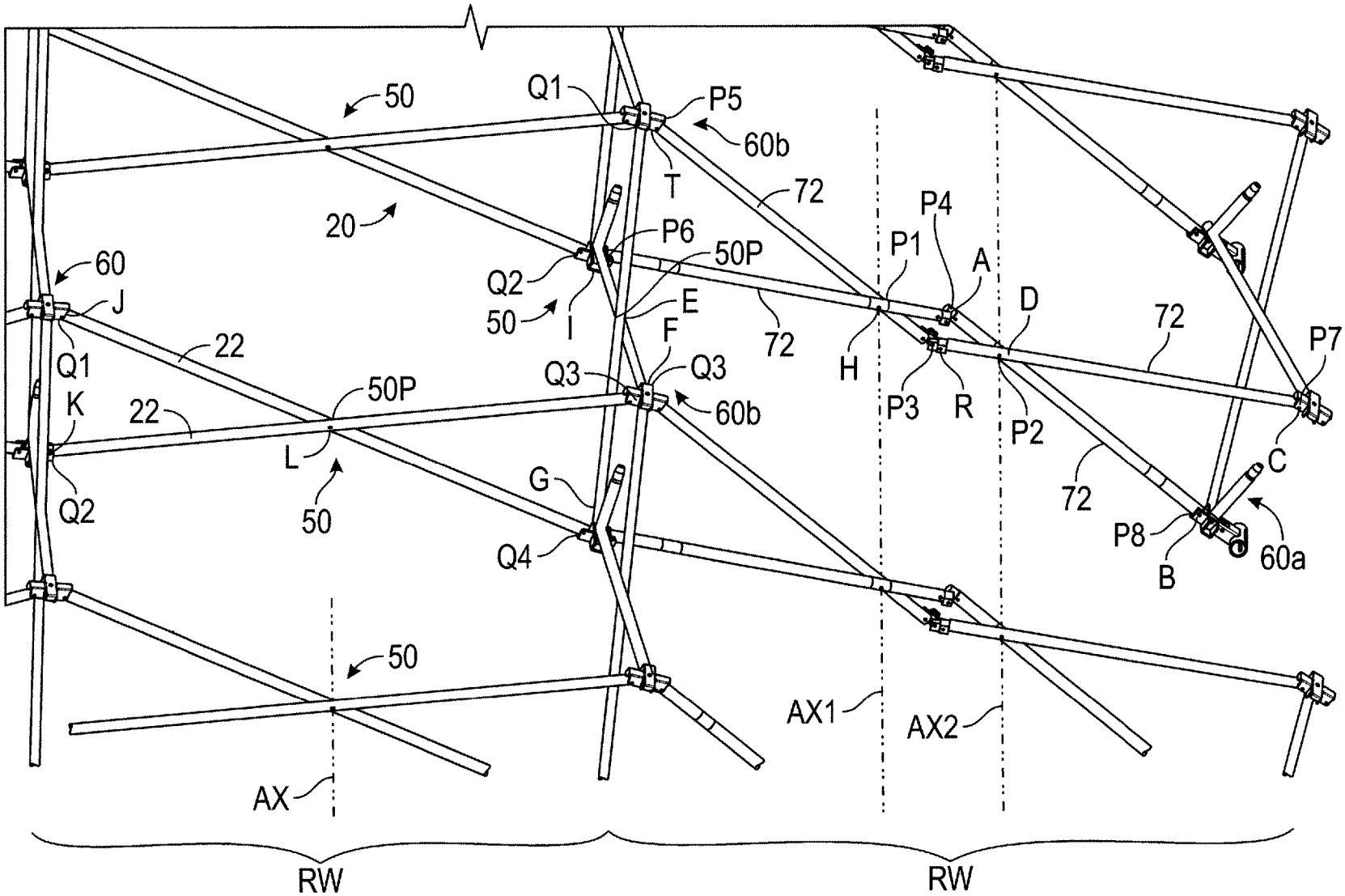
FIG. 5B illustrates a frame formed in accordance with the present development and is labeled to illustrate certain structural relationships required for the frame to articulate between its stored and deployed conditions.

For ease of reference herein, the pivot points where the first and second elongated struts 72*a*,72*b* are respectively connected at their outer ends 74 to the upper and lower hub portions 62,64 of the outer hub 60*a* are respectively labeled P5,P6 in FIGS. 4A and 5B, and the pivot points wherein the third and fourth struts 72*c*,72*d* are respectively connected at their outer ends 74 to the upper and lower hub portions 62,64 of the inner hub 60*b* are respectively labeled P7,P8 in FIGS. 4A and 5B.

The inner ends 76 of the first and third elongated struts 72*a*,72*c* are pivotally interconnected at a third pivot point P3, and the inner ends 76 of the second and fourth elongated struts 72*b*,72*d* are pivotally interconnected at a fourth pivot point P4 such that the first, second, third, and fourth pivot points P1-P4 and the portions of the elongated struts 72 that extend therebetween define a four-bar parallelogram accommodating linkage AK.

It should be noted that a first sum of the distances (lengths) of the portions of the elongated struts 72*a*,72*b* that extend between the pivot points adjacent outer hub 60*a* and the first pivot point P1 is equal to a second sum of the distances (lengths) of the portions of the elongated struts 72*c*,72*d* that extend between the pivot points adjacent inner hub 60*b* and the second pivot point P2. Furthermore, these distances (the first sum and the second sum) are also each equal to a third sum of distances (lengths) defined along the struts 22 between the pivot points Q1,Q2,Q3,Q4 adjacent each hub 60 and the internal pivot point 50P of the primary scissor linkage segments 50, which allows the frame 20 to articulate between its folded and erected positions. Each accommodating linkage AK thus adds length to the double-scissor linkage segments 70 when the frame 20 is erected and absorbs or removes length from the double-scissor linkage segments 70 when the frame 20 is folded. This allows the double-scissor linkage segments 70 of length 70L to be used in a frame 20 that includes shorter, primary scissor linkage segments 50 of length 50L where needed to increase the length or width of the wall segments 30*s* or roof segments 40*s* while still allowing the frame 20 to articulate into a cube configuration as shown in FIG. 3 for storage and transportation.

These relationships required for the frame to articulate as described are explained further with reference to FIG. 5B. In FIG. 5B and equations below, each pair of capital letters represents the length of a linear strut segment having its opposite end points located at the pivot points corresponding to the location of the capital letter used to identify each end of the segment. In other words, the length of each strut segment represented in the equations below is measured from the pivot point at a first end (indicated by the first capital letter of the segment name) to the pivot at an opposite second end (indicated by the second capital letter of the segment name). Thus, in FIG. 5B, each capital letter represents the pivot point associated with a particular frame strut 22,72 at the indicated hub or other pivot location (or at a different corresponding location), depending upon which strut is being referenced. It can be seen that the following relationships must be maintained for the frame 20 to articulate:

$$JL+LK=FL+LG=IE+ET=FE+EG=TH+HI=CD+DB \quad \text{Equation 1}$$

$$KL+LF=JL+LG=TE+EG=IE+EF=TH+DB=IH+DC \quad \text{Equation 2}$$

$$HA+AD=HR+RD \quad \text{Equation 3}$$

$$AH+HR=AD+DR \quad \text{Equation 4}$$

In addition to the above, for any given row RW of parallel, spaced-apart linkages 50,70, an axis of rotation or axis of articulation AX (for primary scissor linkages 50) and AX1, AX2 (for double-scissor linkages 70) must be maintained along the entire length of the row RW, meaning that for any given row of parallel, spaced-apart linkages 50,70 none of the primary (conventional) scissor linkages 50 can be replaced with a double-scissor linkage 70 (or vice versa) without replacing all of the primary (conventional) scissor linkages 50 with a double-scissor linkages 70 in the same row RW of linkages, as there would be pivot pin locations on the double-scissor linkages 70 that would not be present on the primary scissor linkages 50.

Use of the double-scissor segments 70 also allows for wall sections 30*s* or roof sections 40*s* to have different lengths than widths, i.e., to be rectangular but not square. In the illustrated example, the use of the double-scissor segments 70 provides for an increased eave height EH without increasing the length 50L of each roof segment 50 as would greatly increase the overall roof height RH at its peak.

FIG. 5A is view of detail "5A" of FIG. 1 and partially shows a double-scissor linkage segment 70. FIG. 5A shows an example of a hard stop knee hinge 80 that can be used to provide the third and fourth pivot points P3,P4 of the accommodating linkage AK. The illustrated hard stop knee hinge 80 includes a first or lower portion 82 connected to one of the struts 72 that defines a slot 82*s* between first and second lateral walls 82*w*. The hard stop knee hinge 80 further includes a second or upper portion 84 connected to another one of the struts 72 that defines a projecting tab or tongue 86 that is closely slidably received in the slot 82. A pivot pin pivotally connects the tab 86 to the walls 82*w* and captures the tab 86 in the slot 82*s* to define the third and fourth pivot points P3,P4. The walls 82*w* of the slot 82*s* prevent undesired lateral flexing of the struts 72 relative to each other (the walls 82*w* confine movement to rotational movement about the pivot point P3,P4), and hard contact between an end 86*s* of the tongue 86 and the lower knee hinge portion 82 defines a stop ST that prevents over (hyper) extension of the struts 72 relative to each other, i.e., the stop ST blocks pivoting movement of the tab 86 relative to the slot 82*s* at a select angular orientation when the third and fourth pivot points P3,P4 are moving toward each other when the frame 20 is erected. Alternatively, a hard stop can be provided by other contact between the first and second hinge portions 82,84 such as contact outside the slot 82*s* and/or by hard contact between at least two struts 72. It is not intended that the present development be limited to the hinge example shown in FIG. 5A, and any other suitable hinge structure can be used for providing the pivot points P3,P4.

Figure 6:
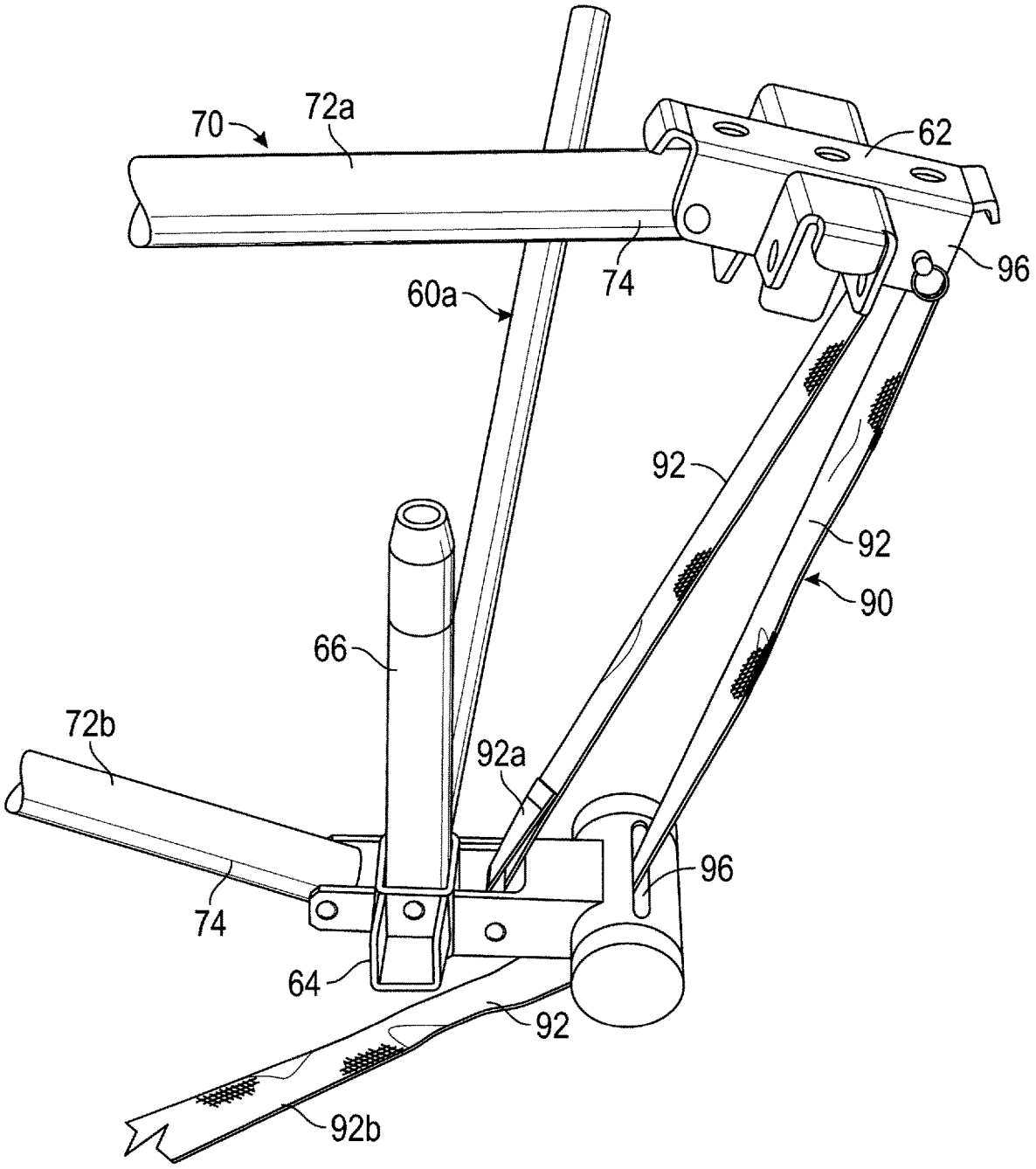
FIG. 6 shows detail region 6 of FIG. 1 with the shelter frame in the partially erected/deployed configuration and shows a ground strap cinch system according to an embodiment of the present invention.

FIG. 6 shows detail "6" of FIG. 1 with the shelter frame 20 in its partially erected/deployed configuration. The frame 20 comprises an optional ground strap cinch system 90 according to an embodiment of the present invention. The ground strap cinch system 90 is provided to facilitate the assembly of the outer hubs 60*a* located along the length FL of the frame 20 on its opposite lateral sides 20*c*,20*d*. During erection of the shelter 10, these laterally outermost hubs 60*a* have heretofore been difficult to assemble by connecting the upper hub portion 62 to the hub post 66 as required and assembling these outer hubs 60*a* is an important part of erecting the frame 20. According to the illustrated embodiment of the present frame 20 and shelter 10, each outer hub 60*a* comprises a ground strap cinch system 90 including a flexible cinch member 92 such as a strap, rope, cable, chain, and/or a combination of same and/or any other elongated flexible member. The flexible cinch member 92 includes an inner end or other inner portion 92*a* that is fixedly connected to one of the upper and lower hub portions 62,64. In the illustrated example of FIG. 6, the inner end 92*a* is secured the lower hub portion 64 using a sewn loop in the flexible cinch member 92 that is engaged with a pin or other structure of the lower hub portion 64. The flexible cinch member 92 is also threaded between the upper and lower hub portions 62,64 in a block-and-tackle or similar back-and-forth arrangement to provide mechanical advantage. As shown herein, the cinch member 92 extends from the hub portion 62,64 to which it is connected (lower hub portion 64 in the present example—referred to as a "first" hub portion)

to the other, opposite hub portion 62,64 (upper hub portion 62 in the present example—a "second" hub portion) where it is slidably or otherwise movably engaged with said second hub portion 62 and the cinch member 92 then extends back to the first hub portion 64 again where it is slidably or otherwise movably engaged with said first hub portion 64 such that tension applied to the free portion of the cinch member 92 that extends from the first hub portion causes the cinch member 92 to draw the upper and lower hub portions 62,64 together and toward each other such that the hub post 66 can be fitted into the upper hub portion 62. The inner end 92*a* of the cinch member 92 can alternatively be fixedly secured to the upper hub portion 62 in which case the upper hub portion 62 is the first hub portion and the lower hub portion 64 is the second hub portion. A pulley or other friction reducing roller or bushing 96 can be provided at the upper and/or lower hub portions 62,64 where the strap 92 changes direction. A free end 92*b* of the strap 92 is pulled by a user to draw the upper hub portion 62 into engagement with the hub post 66 projecting from the lower hub portion 64 (see FIG. 4). In the present embodiment, the double-scissor linkage 70 goes "over-center" when the upper hub portion 62 engages the hub post 66 such that the upper hub portion 62 stays in engagement with the post 66 until manually disengaged therefrom when the frame 20 is manually collapsed. Alternatively, a lock pin or other fastener can be used to secure the upper hub 62 to the hub post 66 once they are engaged. The free ends 92*b* of straps or other cinch members 92 located on opposite lateral sides 20*c*,20*d* of the frame 20 can be connected together with clips, a buckle or the like to prevent the opposite lateral sides 20*c*,20*d* of the frame 20 from spreading apart from each other. In another alternative embodiment, the straps or other cinch members 92 are connected to and/or integrated into a floor covering FC that covers the ground GR inside the shelter (see also FIG. 1).

Figure 7:
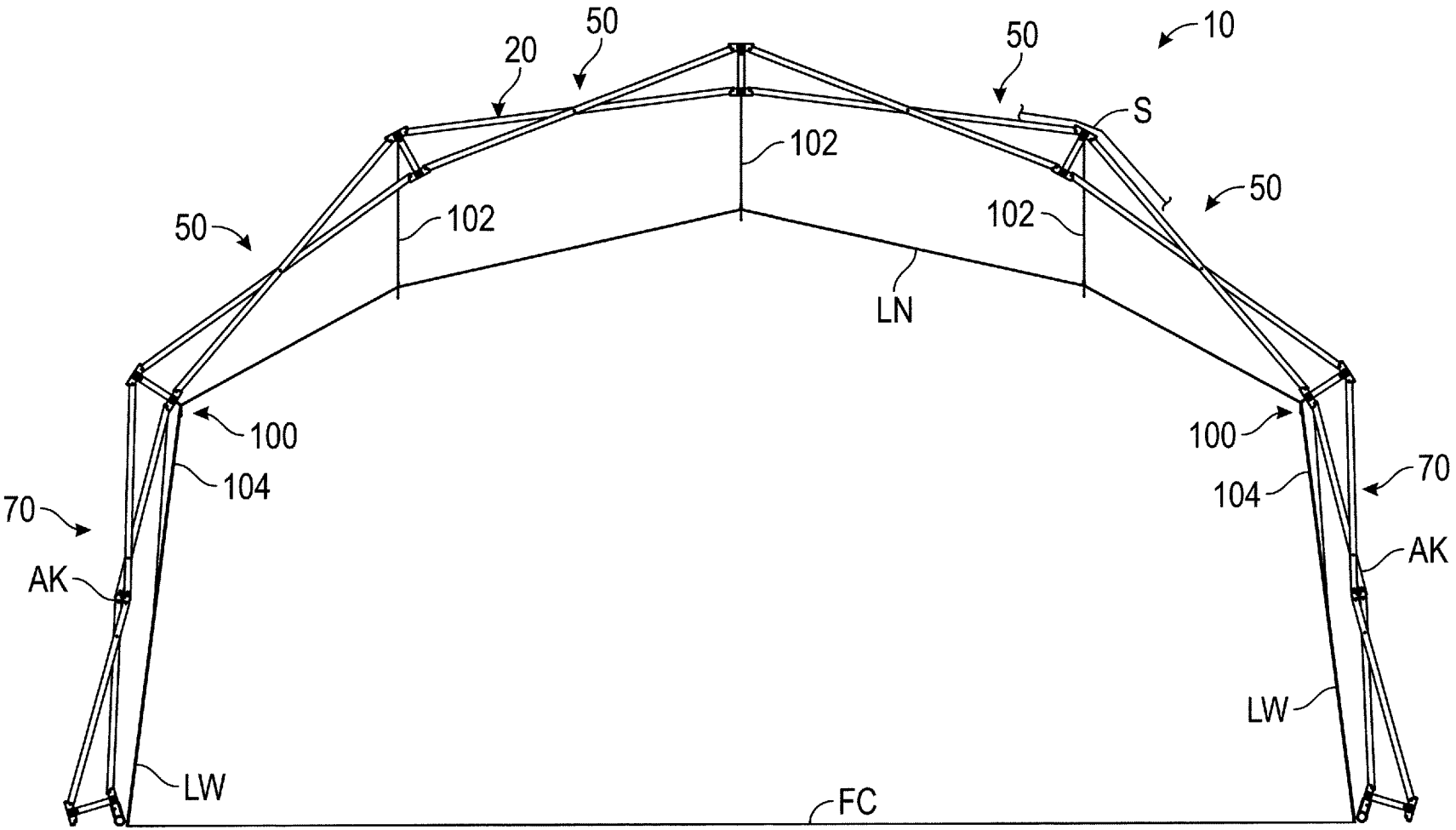
FIG. 7 is an end view of a shelter provided in accordance with an embodiment of the present invention including the outer shell and also including optional inner liner, and including a dynamic liner cinching system.
Figure 8:
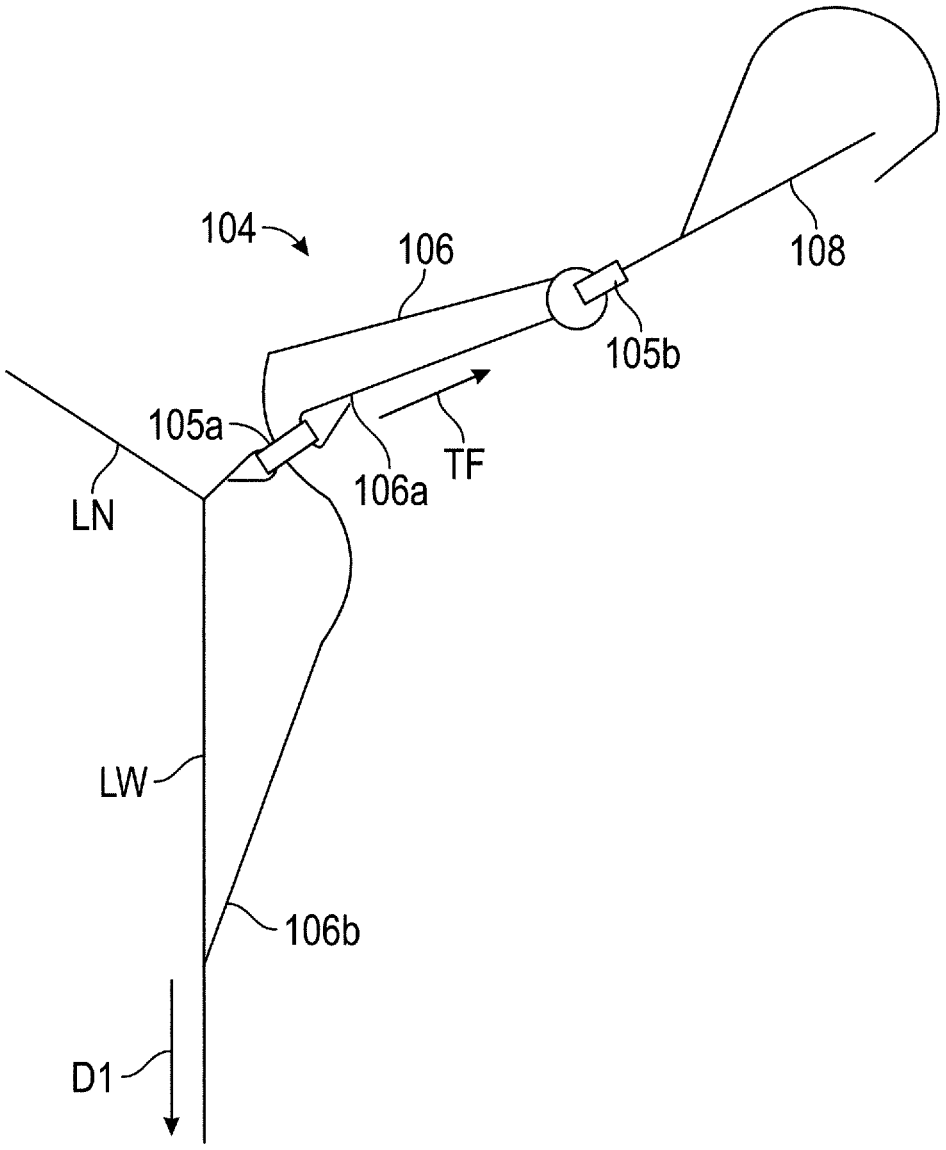
FIG. 8 illustrates an embodiment of the dynamic liner cinching system of the present invention.

FIG. 7 is an end view of an alternative shelter 10 provided in accordance with an embodiment of the present invention including the outer shell S and optional inner liner LN made from canvas or another flexible fabric or membrane, and including a dynamic liner cinching system 100. FIG. 8 illustrates an embodiment of the dynamic liner cinching system 100. The liner LN is suspended from the frame 20 (e.g., from the upper hub portion 62 of multiple hubs 60) by straps 102. Preferably, the liner LN is connected to the frame 20 when the frame is only partially erected which requires a certain amount of slack in the liner. To prevent the excess slack in the liner LN when the frame 20 is fully erected, the dynamic liner cinching system 100 is provided. The liner includes first and second wall portions LW. The liner cinching system 100 includes a plurality of strap cinches 104 spaced along the length of each liner wall portion LW and along the length FL of the frame 20. Each strap cinch 104 comprises a first loop or ring 105*a* connected to the liner wall LW, a second loop or ring 105*b* releasably connected to the frame 20 by a connector 108 such as a snap hook connector or the like, and a flexible strap 106 (which can comprise a flat or cylindrical or otherwise shaped web, cord, or other member). The strap 106 includes a first end 106*a* fixedly secured or connected to the first ring 105*a*. The strap 106 extends from the first end 106*a* slidably through the second ring 105*b* and then slidably through the first ring 105*a*. A second end or other portion 106*b* of the strap 106 spaced from the first end 106*a* is preferably connected to the liner wall LW such that the weight of the liner wall pulls the strap 106 downward in the direction D1 such that the first ring 105*a* is pulled or drawn toward the second ring 105*b* as indicated by the arrow TF to correspondingly pull or draw the inner liner LN toward the second ring 105*b* and outwardly toward the frame 20. The first and second loops/rings 105*a*,105*b* can each be made from any suitable material such as metal, a polymeric material, wood, a fabric webbing or cord, or other suitable material. In one embodiment, the strap connector 108 is connected to an upper hub portion 62 of the frame 20 using a ring 100R (see FIG. 10) or the like so that the tension on the strap 106 further serves to urge the upper hub portion 62 toward the lower hub portion 64, but the strap connector 108 can be connected to any other suitable location on the frame 20. As noted, the strap 106 is threaded and connected as shown in FIG. 8 and as described so that downward movement D1 of the liner wall LW by gravity or other force when the frame 20 is fully erected results in and causes an outward pulling or tensioning force TF being exerted on the liner LN to pull the liner outwardly toward the frame 20 and remove slack from the liner LN. The liner wall LW can be manually pulled downward D1 and fastened to the frame 20 or ground GR or secured with weights, clips, or the like in such position to maintain the tension force TF on the liner LN. The liner wall LW can also optionally be connected to the optional floor covering FC (see also FIG. 1).

Figure 9:
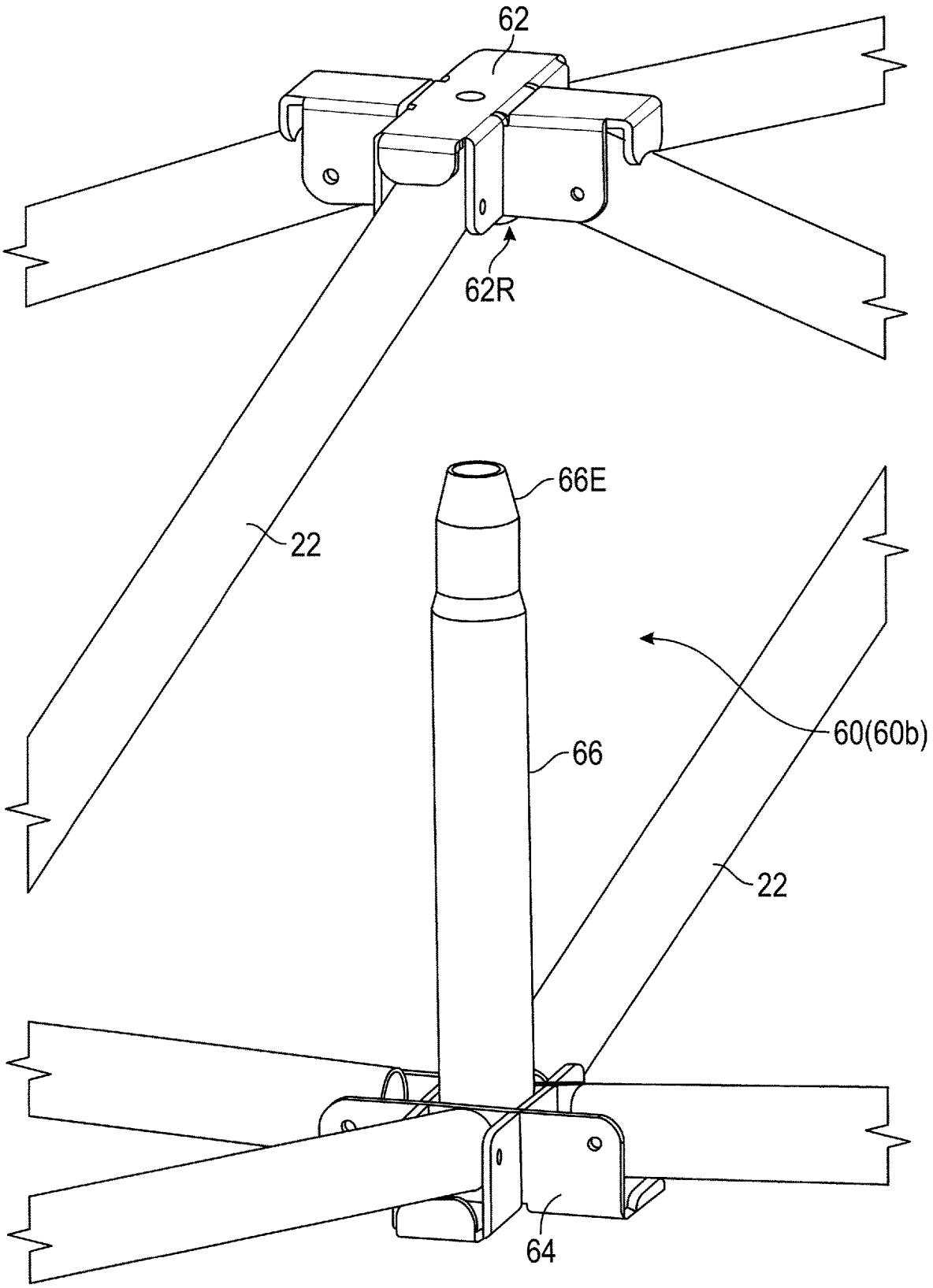
FIGS. 9 and 10 partially show a shelter frame according to the present invention and illustrate an embodiment of the hub structure thereof, with FIG. 9 showing the frame partially deployed/erected and FIG. 10 showing the frame fully deployed/erected.
Figure 10:
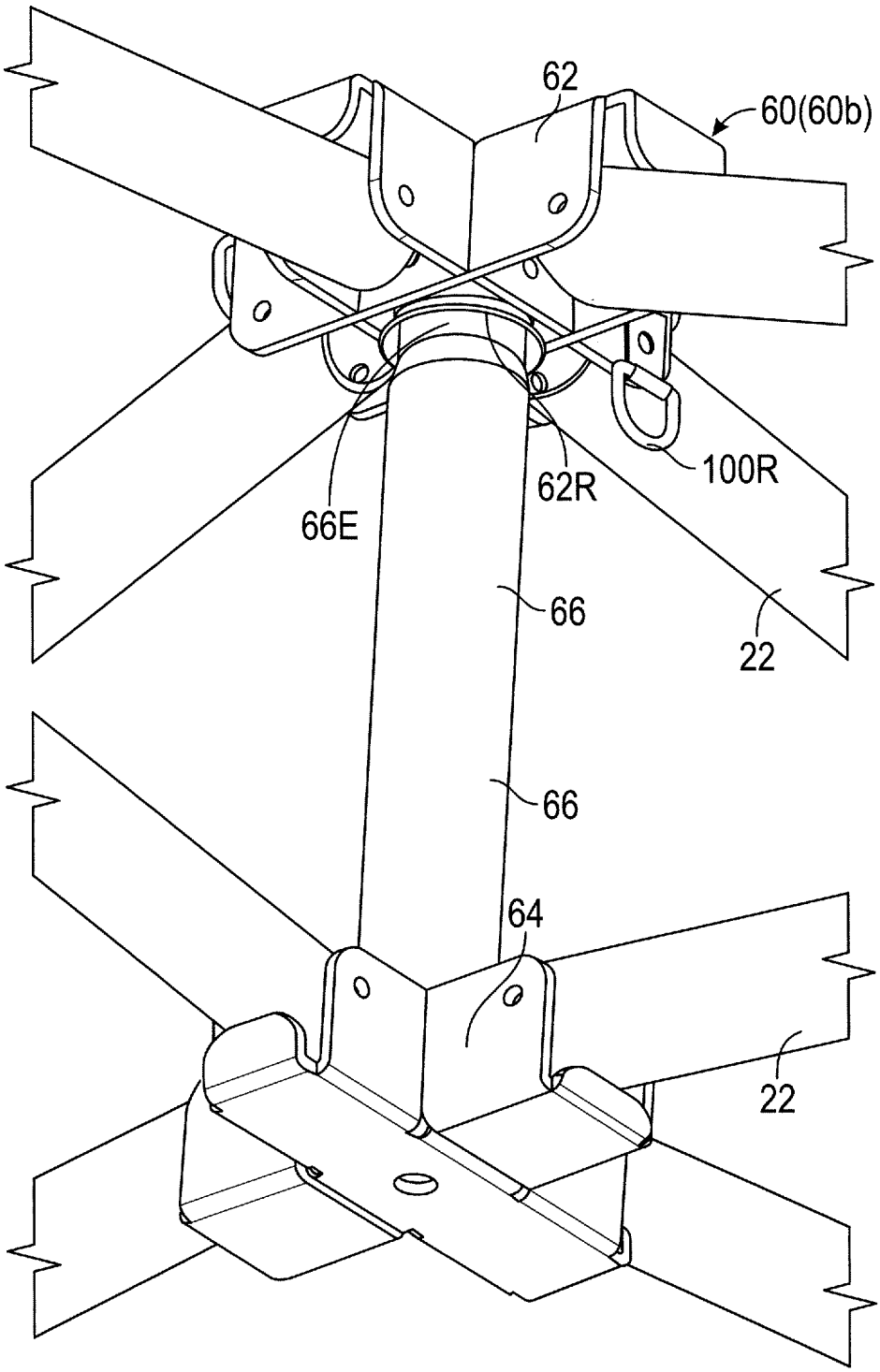

The hubs 60 of the frame are preferably constructed as shown in FIGS. 9 & 10. In particular, the upper hub portion 62 includes a cylindrical or other cup-like receiver 62R that closely receives the projecting end 66E of the hub post 66. The hub post end 66E and the receiver 62R can each have any desired shape such as cylindrical, square, triangular, etc. Preferably, the post end 66E and receiver 62R are shaped to correspond with each other to minimize movement of these components relative to each other in any direction except axial movement along the longitudinal axis of the hub post 66 required to assemble or disassembly the hub 60. As noted above, the end 66E of the post 66 is held in the receiver 62R without fasteners when the linkages 50, 70 go over-center when the frame 20 is fully erected, although a pin or other fastener can alternatively be used to secure the post end 66E in the receiver 62R.

Figure 11A:
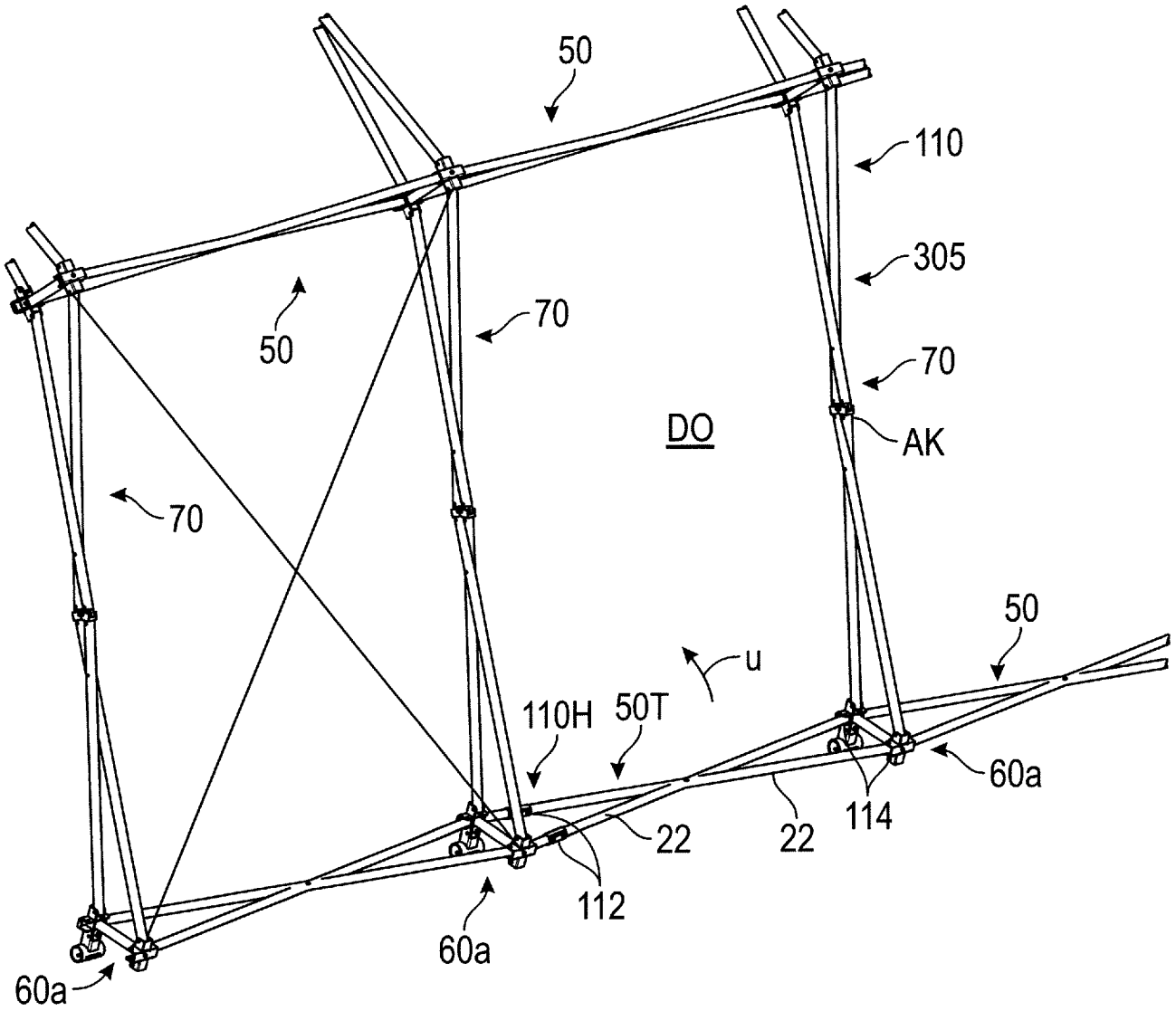
FIGS. 11A & 11B are views of the shelter frame of FIG. 1 showing an optional folding or pivoting door threshold structure in its extended (down) and retracted (up) positions, respectively.
Figure 11B:
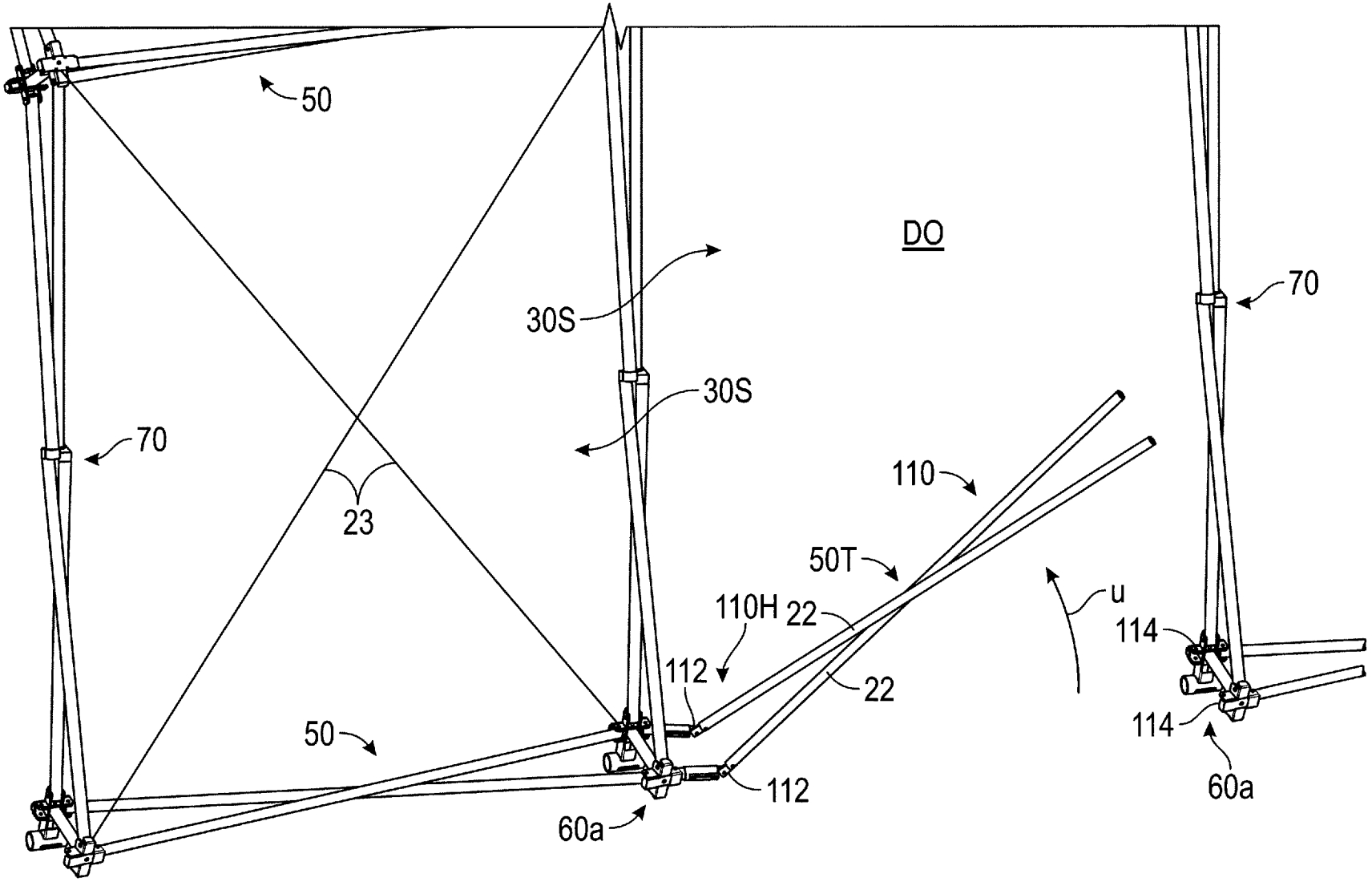

As shown in FIGS. 11A and 11B, the shelter frame 20 optionally comprises at least one or a plurality of folding or pivoting thresholds 110. FIG. 11A shows the pivoting threshold 110 in its extended (down) position and FIG. 11B shows the pivoting threshold 110 in its retracted (up) position. When a wall section 30*s* is used as a door opening DO for movement of people and equipment into the shelter 10, a conventional scissor linkage segment 50 that extends horizontally across the wall section 30*s* adjacent the floor or ground GR defines a door threshold that can obstruct the door opening and that can be damaged and present a trip hazard. To overcome this drawback, a frame 20 provided in accordance with the embodiment of the present invention shown in FIGS. 11A & 11B includes a folding threshold 110. The folding threshold comprises a threshold scissor linkage 50T that is identical to the primary scissor linkage 50 except that first and second struts 122*a*,122*b* (generally 122) of the folding scissor linkage 50T are respectively pivotally connected at their respective first ends end to a first adjacent hub 60*a*1 by a threshold hinge 110H comprising first and second hinges 112 such as pins or the like that respectively pivotally connect the first and second struts 122*a*,122*b* to the hub 60*a*1. The opposite second ends of the first and second struts 122*a*,122*b* are releasably abutted with or connected to a second adjacent hub 60*a*2, e.g., using respective latches 114 or the like. After the frame 20 is erected and secured in position, the second ends of the struts 122 at the second end of the threshold segment 50T spaced from the threshold hinge 110H are disconnected from the second hub 60*a*2 and the threshold segment 50T is pivoted upward at the threshold hinge 110H as indicated by the arrow U until the threshold segment 50T lies adjacent the vertical frame segment 70, and the pivoting threshold segment is then secured in such position adjacent the vertical frame segment 70. No parts are separated from the frame 20 during such pivoting of the threshold segment 50T to prevent loss of frame components. In all embodiments, the frame 20 can optionally include wire or cable stays 23 that extend diagonally between hubs 60 and that are arranged in an X pattern in non-doorways on the left and right walls 30*a*,30*b* to keep the frame 20 from "racking" or tilting to one side or the other.

The disclosure has been described with reference to several embodiments. Modifications and alterations will occur to others upon the reading and understanding of this specification. It is intended to include all such modifications and alterations insofar as they come within the scope of the appended claims or the equivalents thereof.

The invention claimed is:

1. An articulating frame for a shelter, said articulating frame comprising:

a plurality of struts pivotally connected to each other to define a skeletal structure that is adapted to be articulated between a folded condition and an erected condition, said skeletal structure in said erected condition comprising a segmented arch that defines an interior space, said segmented arch skeletal structure adapted to support an associated outer shell covering;

said frame comprising a plurality of primary scissor linkage segments each comprising two primary struts of said plurality of struts pivotally connected together at an inner pivot point;

said frame further comprising at least one double-scissor linkage segment comprising four elongated struts of said plurality of struts, said four elongated struts being longer than said primary struts and including: (i) first and second elongated struts each comprising opposite inner and outer ends, said first and second elongated struts bring pivotally connected to each other at a first pivot point located between their respective inner and outer ends; (ii) third and fourth elongated struts each comprising opposite inner and outer ends, said third and fourth elongated struts being pivotally connected to each other at a second pivot point located between their respective inner and outer ends;

said inner end of said first elongated strut being pivotally connected to said inner end of said third elongated strut at a third pivot point and said inner end of said second elongated strut being pivotally connected to said inner end of said fourth elongated strut at a fourth pivot point such that a four-bar parallelogram accommodating linkage is defined by said four elongated struts between said first pivot point, said second pivot point, said third pivot point, and said fourth pivot point;

wherein an outer end of said at least one double-scissor linkage segment is connected to an outer hub and an inner end of said at least one double-scissor linkage segment is connected to an inner hub, said inner and outer hubs each comprising: (i) an upper hub portion; (ii) a lower hub portion spaced-apart from said upper hub portion; and, (iii) a hub post that extends between said upper hub portion and said lower hub portion;

said first and second elongated struts of said double-scissor linkage respectively pivotally connected to said upper and lower hub portions of said outer hub at fifth and sixth pivot points;

said third and fourth elongated struts of said double-scissor linkage respectively pivotally connected to said upper and lower hub portions of said inner hub at seventh and eighth pivot points;

wherein at least one of said plurality of primary scissor linkage segments is pivotally connected to said upper and lower hub portions of said inner hub.

2. The articulating frame for a shelter as set forth in claim 1, wherein:

a first distance is defined between the fifth pivot point and the first pivot point;

a second distance is defined between the sixth pivot point and the first pivot point;

a third distance is defined between the seventh pivot point and the second pivot point;

a fourth distance is defined between the eighth pivot point and the second pivot point;

the first distance+the second distance=the third distance+the fourth distance.

3. The articulating frame for a shelter as set forth in claim 2, wherein:

the first distance+the fourth distance=the second distance+the third distance.

4. The articulating frame for a shelter as set forth in claim 3, wherein:

a fifth distance is defined between the first pivot point and the third pivot point;

a sixth distance is defined between the first pivot point and the fourth pivot point;

a seventh distance is defined between the second pivot point and the third pivot point;

an eighth distance is defined between the second pivot point and the fourth pivot point;

the fifth distance+the sixth distance=the seventh distance+the eighth distance; and the sixth distance+the eighth distance=the fifth distance+the seventh distance.

5. The articulating frame for a shelter as set forth in claim 1, wherein one of the upper and lower hub portions of the outer hub is a first hub portion and the other of the upper and lower hub portions of the outer hub is a second hub portion, and wherein said frame further comprises a ground strap cinch system comprising a flexible cinch member connected to the first hub portion and threaded from said first hub portion to said second hub portion and back again to said first hub portion such that tension applied to a free end of said flexible cinch member draws the first and second hub portions toward each other.

6. The articulating frame for a shelter as set forth in claim 5, wherein at least one of the first and second hub portions comprises a roller with which said flexible cinch member is engaged.

7. The articulating frame for a shelter as set forth in claim 6, wherein said flexible cinch member is connected to a floor covering that is adapted to cover a ground surface on which said frame is supported.

8. The articulating frame for a shelter as set forth in claim 1, further comprising an outer shell covering connected to said skeletal structure.

9. An articulating frame for a shelter, said articulating frame comprising:

a plurality of struts pivotally connected to each other to define a skeletal structure that is adapted to be articulated between a folded condition and an erected condition, said skeletal structure in said erected condition comprising a segmented arch that defines an interior space, said segmented arch skeletal structure adapted to support an associated outer shell covering;

said frame including at least one double-scissor linkage segment, said at least one double-scissor linkage segment comprising four of said plurality of struts, said four struts including: (i) first and second struts each comprising opposite inner and outer ends, said first and second struts bring pivotally connected to each other at a first pivot point located between their respective inner and outer ends; (ii) third and fourth struts each comprising opposite inner and outer ends, said third and fourth struts being pivotally connected to each other at a second pivot point located between their respective inner and outer ends;

said inner end of said first strut being pivotally connected to said inner end of said third strut at a third pivot point and said inner end of said second strut being pivotally connected to said inner end of said fourth strut at a fourth pivot point such that a four-bar parallelogram accommodating linkage is defined by said four struts between said first pivot point, said second pivot point, said third pivot point, and said fourth pivot point;

said articulating frame further comprising an inner liner suspended from the frame, said liner comprising a liner cinching system comprising:

a first ring connected to a liner wall of the liner;

a second ring releasably connected to the frame;

a strap including a first end fixedly secured to the first ring and extending from the first end slidably through the second ring and then through the first ring, said strap further comprising a portion spaced from the first end that is connected to the liner wall whereby downward movement of said liner wall exerts a tensioning force on said strap such that the first ring is drawn toward the second ring and said inner liner is drawn outwardly toward said frame.

10. The articulating frame for a shelter as set forth in claim 9, wherein said second ring is connected to a snap hook connector that is releasably connected to said frame.

11. An articulating frame for a shelter, said articulating frame comprising:

a plurality of struts pivotally connected to each other to define a skeletal structure that is adapted to be articulated between a folded condition and an erected condition, said skeletal structure in said erected condition comprising a segmented arch that defines an interior space, said segmented arch skeletal structure adapted to support an associated outer shell covering;

said frame including at least one double-scissor linkage segment, said at least one double-scissor linkage segment comprising four of said plurality of struts, said four struts including: (i) first and second struts each comprising opposite inner and outer ends, said first and second struts bring pivotally connected to each other at a first pivot point located between their respective inner and outer ends; (ii) third and fourth struts each comprising opposite inner and outer ends, said third and fourth struts being pivotally connected to each other at a second pivot point located between their respective inner and outer ends;

said inner end of said first strut being pivotally connected to said inner end of said third strut at a third pivot point and said inner end of said second strut being pivotally connected to said inner end of said fourth strut at a fourth pivot point such that a four-bar parallelogram accommodating linkage is defined by said four struts between said first pivot point, said second pivot point, said third pivot point, and said fourth pivot point;

wherein said third and fourth pivot points comprise respective knee hinges, each of said knee hinges comprising:

a first portion comprising a slot defined between first and second lateral walls;

a second portion comprising a projecting tab that is closely slidably received in the slot; and, a pivot pin that pivotally captures the tab in the slot.

12. The articulating frame for a shelter as set forth in claim 11, wherein hard contact between said tab and said first portion of said knee hinge provides a hard stop that blocks pivoting movement of the tab relative to the slot at a select angular orientation.

* * * * *